US008366465B2

(12) United States Patent
Cheng

(10) Patent No.: US 8,366,465 B2
(45) Date of Patent: Feb. 5, 2013

(54) PLUG APPARATUS

(75) Inventor: Quan-Chang Cheng, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/213,068

(22) Filed: Aug. 18, 2011

(65) Prior Publication Data

US 2012/0171880 A1 Jul. 5, 2012

(30) Foreign Application Priority Data

Dec. 31, 2010 (CN) ..... 2010 1 0616907

(51) Int. Cl.
*H01R 29/00* (2006.01)

(52) U.S. Cl. ..... 439/172

(58) Field of Classification Search ..... 439/172, 439/170, 175, 176, 177, 169, 166, 246, 638, 439/669, 639, 641, 642, 214, 578, 579, 580, 439/581, 582, 583, 584, 585
See application file for complete search history.

(56) References Cited

U.S. PATENT DOCUMENTS

| | | | | |
|---|---|---|---|---|
| 4,367,001 | A * | 1/1983 | Munakata | 439/175 |
| 4,803,728 | A * | 2/1989 | Lueken | 439/638 |
| 4,944,686 | A * | 7/1990 | Gertz | 439/175 |
| 5,419,707 | A * | 5/1995 | Kelley | 439/21 |
| 5,658,158 | A * | 8/1997 | Milan | 439/214 |
| 5,791,919 | A * | 8/1998 | Brisson et al. | 439/166 |
| 5,885,109 | A * | 3/1999 | Lee et al. | 439/652 |
| 6,406,313 | B1 * | 6/2002 | Victor | 439/175 |
| 6,600,826 | B1 * | 7/2003 | Xavier | 381/384 |
| 6,981,895 | B2 * | 1/2006 | Potega | 439/578 |
| 7,121,872 | B1 * | 10/2006 | Hanks | 439/427 |
| 7,144,273 | B1 * | 12/2006 | Chawgo | 439/583 |

* cited by examiner

*Primary Examiner* — Renee S Luebke
*Assistant Examiner* — Harshad Patel
(74) *Attorney, Agent, or Firm* — Altis Law Group, Inc.

(57) ABSTRACT

A plug apparatus includes a main body, and a plurality of plugs. The plugs have different plug tips of different recognized standards. The plugs are capable of electrically and detachably sleeving on each other. Each plug is also capable of electrically and detachably sleeving on the main body. When one of the plugs (a first plug) sleeves on the other plug (a second plug), the plug tip of the second plug is hidden by the first plug.

14 Claims, 4 Drawing Sheets

PLUG APPARATUS

BACKGROUND

1. Technical Field

The present disclosure relates to plug apparatus.

2. Description of Related Art

A typical plug apparatus often has only one plug tip. The plug apparatus is electrically connected to an electronic device by the plug tip being inserted into a socket of the electronic device. However, the plug apparatus cannot be used when the socket of the electronic device is different from the plug tip.

Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout four views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
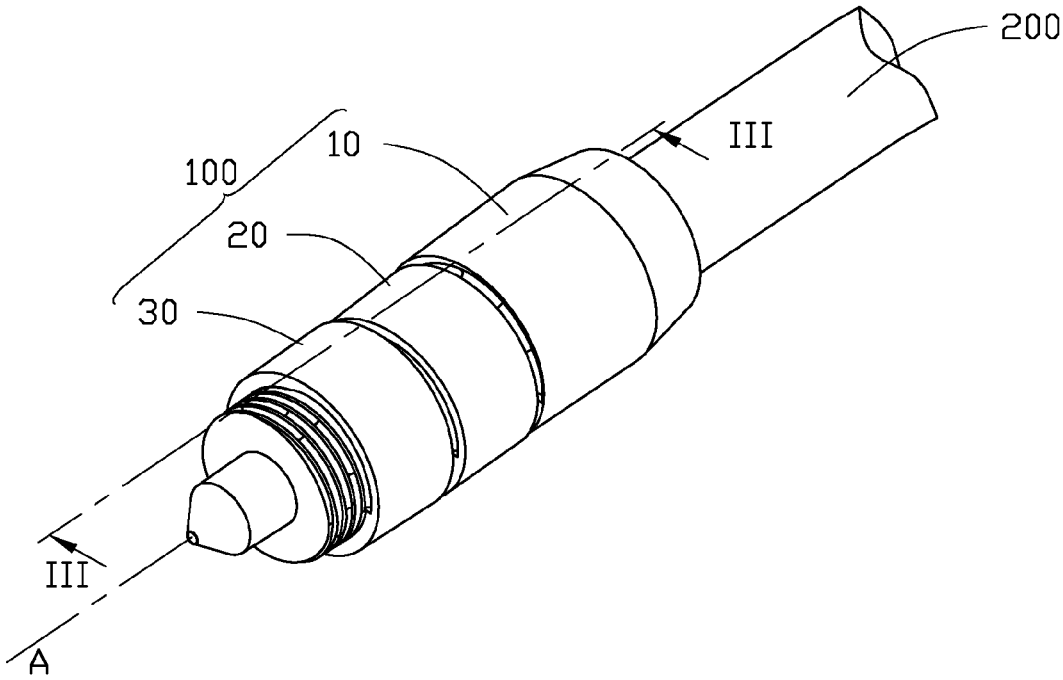
FIG. 1 is a perspective view of a plug apparatus in accordance with an embodiment.

Referring to FIG. 1, a perspective view of a plug apparatus 100 in accordance with an embodiment is shown. The plug apparatus 100 is electrically connected to a peripheral device (such as an earphone) via a cable 200. The plug apparatus 100 can be inserted into a socket of an electronic device (not shown), such that the peripheral device is electrically connected to the electronic device. The plug apparatus 100 includes a main body 10 and a plurality of plugs successively secured to the main body 10. The plurality of plugs have various plug tips for being inserted into corresponding types of sockets. For simplicity, hereinafter, a first plug 20 and a second plug 30 are described for explaining the structure of the plug apparatus 100.

Figure 2:
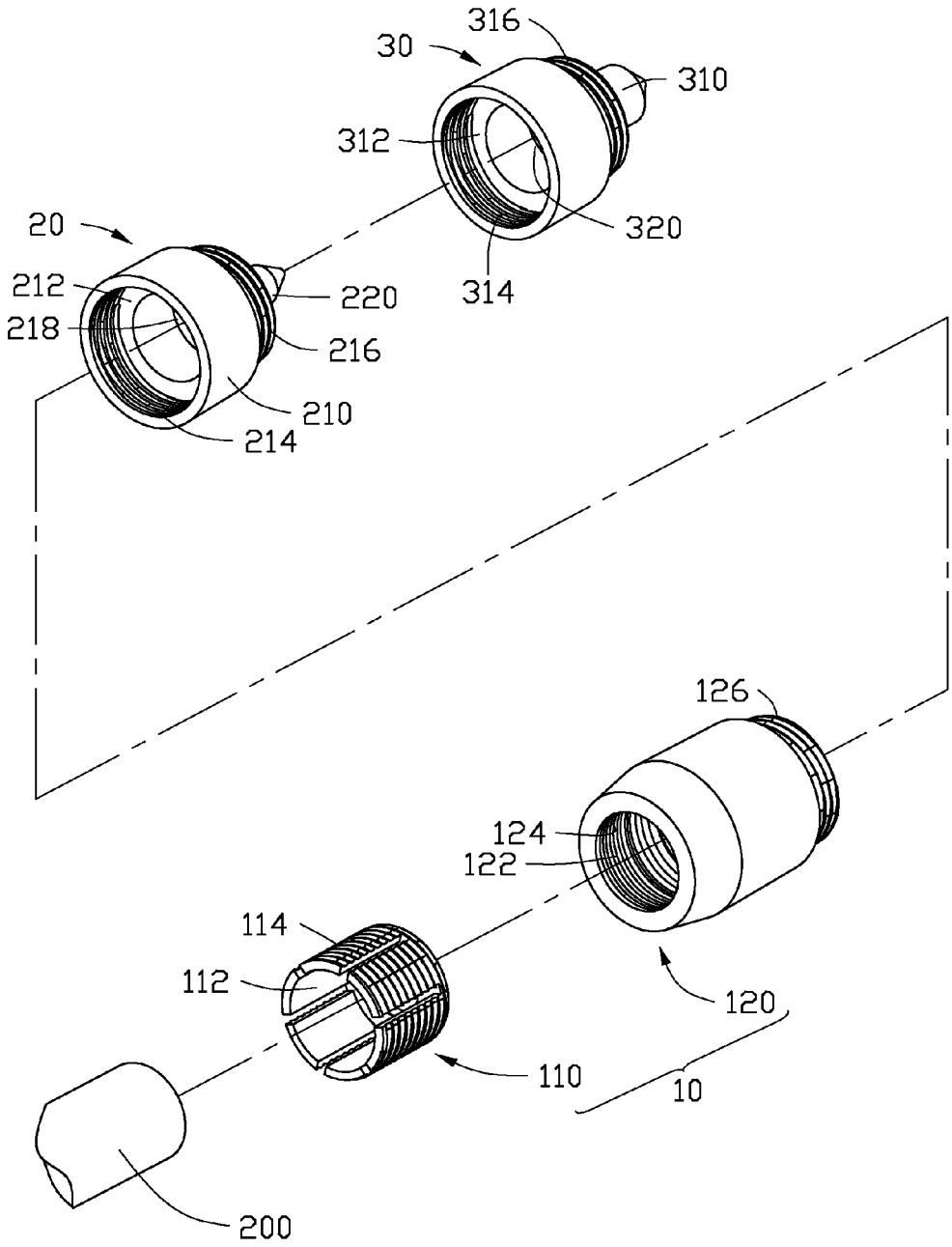
FIG. 2 is a disassembled perspective view of the plug apparatus of FIG. 1.
Figure 3:
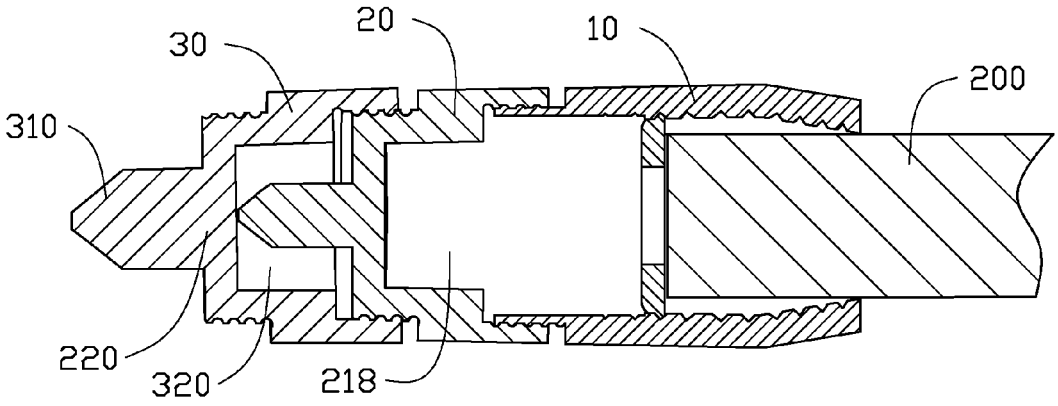
FIG. 3 is a cross-sectional view taken along line III-III of FIG. 1.

Referring to FIGS. 2 and 3, the main body 10 is a substantially hollow cylinder and has an axis A. The main body 10 is electrically connected to the cable 200. The main body 10 includes a fixing portion 110 and a connecting portion 120 into which the fixing portion 110 may be threaded.

The fixing portion 110 is electrically connected to an end of the cable 200. The fixing portion 110 defines a receiving hole 112. The receiving hole 112 extends in a direction parallel to the axis A, and is used for receiving an end of the cable 200. The outer surface of the fixing portion 110 (first threads 114) is threaded.

The connecting portion 120 defines a first thread hole 122 including a plurality of internal second threads 124. The first thread hole 122 extends longitudinally, and is adapted to receive the fixing portion 110. The diameter of the first thread hole 122 is substantially equal to that of the fixing portion 110. The second threads 124 match with the first threads 114. The outer surface of the connecting portion 120 defines a plurality of third threads 126. The third threads 126 are arranged adjacent to an end of the connecting portion 120 opposite to the cable 200.

The first plug 20 is electrically connected to and coaxial with the main body 10. The first plug 20 includes a cylindrical portion 210 and a first plug tip 220 arranged at an end of the cylindrical portion 210. The cylindrical portion 210 and the first plug tip 220 are coaxial. An end of the cylindrical portion 210 opposite to the first plug tip 220 longitudinally recesses to define a second thread hole 212. The second thread hole 212 includes a plurality of internal fourth threads 214. The fourth threads 214 engage with the third threads 126. The first plug 20 sleeves on the main body 10 by the third threads 126 threadedly engaging with the fourth threads 214. The end portion of the second thread hole 212 further recesses longitudinally to define a first receiving portion 218. The outer surface of the cylindrical portion 210 further defines a plurality of fifth threads 216. The fifth threads 216 are arranged adjacent to an end of the cylindrical portion 210 adjacent to the first plug top 220.

The second plug 30 is capable of sleeving on and detaching from the first plug 20. The structure of the second plug 30 is substantially similar to the structure of the first plug 20. The second plug 30 has a second plug tip 310. The second plug tip 310 is also of a recognized standard which is different from the first plug tip 220, and the first plug tip 220 and the second plug tip 310 match with different types of sockets, such that the plug apparatus 100 may connect to different electronic devices by means of the first plug 20 and the second plug 30. The second plug 30 defines a third thread hole 312 including a plurality of internal sixth threads 314. The sixth threads 314 threadedly engage with the fifth threads 216, such that the second plug 30 sleeves on the first plug 20. The end portion of the third thread hole 312 recesses longitudinally to define a second receiving portion 320. The size of the second receiving portion 320 is substantially equal to that of the first receiving portion 218. The second receiving portion 320 is used for receiving the first plug tip 220 when the second plug 30 sleeves on the first plug 20. The outer surface of the second plug 30 defines a plurality of seventh threads 316. The seventh threads 316 are arranged adjacent to the second plug tip 310. Furthermore, the sixth threads 314 can also threadedly engage with the third threads 126, and the seventh threads 316 threadedly engage with the fourth threads 214. Thus, the second plug 30 can sleeve on the main body 10 directly, and the first plug 20 can sleeve on the second plug 30 with the second plug tip 210 being received in the first receiving portion 218.

The other plugs (hereinafter described as third plugs and are not shown) of the plug apparatus 100 have various plug tip standards different from both the first plug tip 220 and the second plug tip 310, such that the plug apparatus 100 further matches with more various types of sockets. The structure of each third plug is similar to that of the first and second plugs 20, 30. These plugs successively sleeve on the second plug 30 by threadedly engaging with the seventh threads 316.

Figure 4:
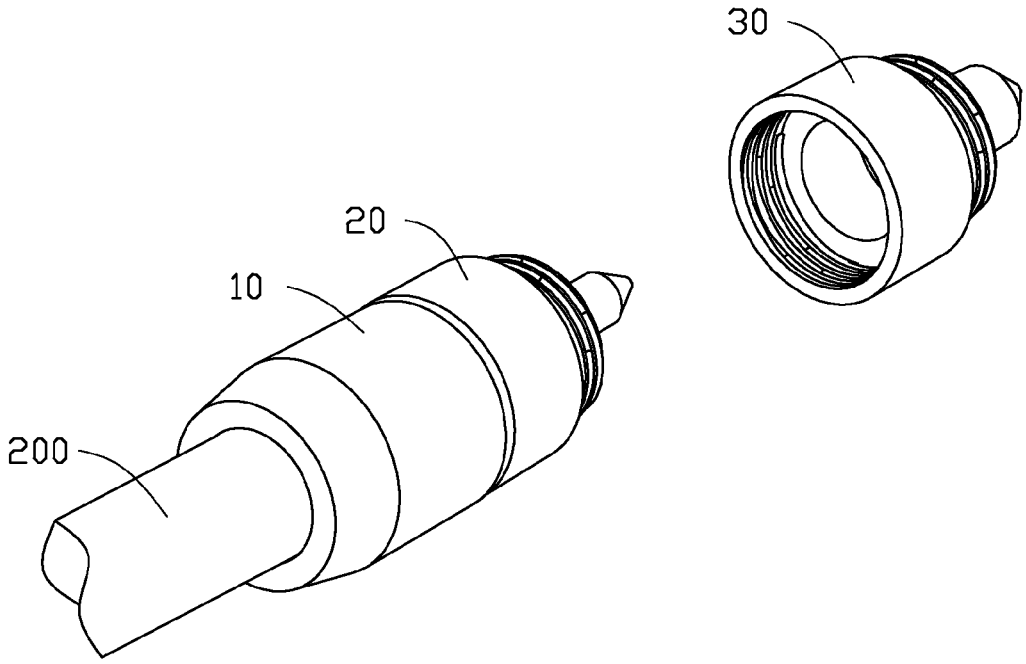
FIG. 4 is a partially assembled perspective view of FIG. 2.

Referring to FIG. 4, in assembly, firstly, the cable 200 is secured to the fixing portion 110, the fixing portion 110 is then threaded into the first thread hole 122; Secondly, the first plug 20 sleeves on the main body 10 by the third threads 126 threadedly engaging with the fourth threads 214. Finally, the second plug 30 sleeves on the first plug 20 by the sixth threads 314 threadedly engaging with the fifth threads 216. Furthermore, the third plugs successively sleeve on the second plug 30 in a manner which is similar to that of the second plug 30 sleeving to the first plug 20.

In use, the first plug 20, the second plug 30, and the third plugs are selectable, therefore the plug apparatus 100 is capable of matching with various sockets.

Even though information and the advantages of the present embodiments have been set forth in the foregoing description, together with details of the structures and functions of the present embodiments, the disclosure is illustrative only; and changes may be made in detail, especially in matters of shape, size, and the arrangement of parts within the principles of the present embodiments to the full extent indicated by the broad general meaning of the terms in which the appended claims are expressed.

What is claimed is:

1. A plug apparatus capable of matching with various sockets, comprising:

a main body; and a first plug capable of electrically and detachably sleeving on the main body; and a second plug capable of electrically sleeving on and detached from the main body;

wherein when the first plug electrically sleeves on the main body, the second plug is sleevable on and detachable from the first plug; and when the second plug electrically sleeves on the main body, the first plug is sleevable on and detachable from the second plug; wherein the first plug comprises a first plug tip, the second plug comprises a second plug tip; the first plug tip and the second plug tip are different from each other and are selectable to match with different sockets; the main body defines a plurality of first threads, the first plug defines a plurality of second threads capable of engaging with the first threads and a plurality of third threads, the second plug defines a plurality of fourth threads capable of engaging with the first threads and the third threads and a plurality of fifth threads capable of engaging with the second threads.

2. The plug apparatus of claim 1, wherein the first plug tip is hidden by the second plug when the second plug electrically sleeves on the first plug, and the second plug tip is hidden by the first plug when the first plug electrically sleeves on the second plug.

3. The plug apparatus of claim 2, wherein the first plug defines a first receiving portion for receiving the second plug tip when the first plug sleeves on the second plug, and the second plug defines a second receiving portion for receiving the first plug tip when the second plug sleeve on the first plug.

4. The plug apparatus of claim 3, wherein the first receiving portion and the second receiving portion are the same.

5. The plug apparatus of claim 4, wherein the size of the first and second receiving portions are larger than the size of the first plug tip and the size of the second plug tip.

6. The plug apparatus of claim 1, wherein the main body, the first and second plugs are coaxial.

7. The plug apparatus of claim 1, wherein the first plug sleeves on the main body by the second threads threadedly engaging with the first threads, and the second plug sleeves on the first plug by the fourth threads threadedly engaging with the third threads.

8. The plug apparatus of claim 1, wherein the second plug sleeves on the main body by the fourth threads threadedly engaging with the first threads, and the first plug sleeves on the second plug by the second threads threadedly engaging with the fourth threads.

9. A plug apparatus, comprising:

a main body; and a plurality of plugs having different plug tips, the plug tips are selectable to match with different sockets, the plugs capable of electrically and detachably sleeving on each other, and each plug capable of electrically and detachably sleeving on the main body;

wherein when one of the plugs sleeves on the other plug, the plug tip of the other plug is hidden by the one of the plugs; wherein the main body defines a plurality of first threads, one of the plugs defines a plurality of second threads capable of engaging with the first threads and a plurality of third threads, the other of the plugs defines a plurality of fourth threads capable of engaging with the first threads and the third threads and a plurality of fifth threads capable of engaging with the second threads.

10. The plug apparatus of claim 9, wherein each plug defines a receiving portion for receiving the plug tip of the other of the plugs when plugs are sleeve on each other.

11. The plug apparatus of claim 10, wherein the size of the receiving portions are larger than the size of each plug tip.

12. The plug apparatus of claim 9, wherein the main body and the plugs are coaxial.

13. The plug apparatus of claim 9, wherein the one of the plugs sleeves on the main body by the second threads threadedly engaging with the first threads, and the other of the plugs sleeves on the one of the plugs by the fourth threads threadedly engaging with the third threads.

14. The plug apparatus of claim 9, wherein the other of the plugs sleeves on the main body by the fourth threads threadedly engaging with the first threads, and the one of the plugs sleeves on the other of the plugs by the second threads threadedly engaging with the fourth threads.

* * * * *